United States Patent [19]

Monacelli

[11] Patent Number: 5,020,712

[45] Date of Patent: Jun. 4, 1991

[54] PNEUMATIC POWERED FASTENER DEVICE

[76] Inventor: Umberto Monacelli, Via Parini, 6, Monza (Milan), Italy

[21] Appl. No.: 333,973

[22] Filed: Apr. 6, 1989

[30] Foreign Application Priority Data

Apr. 7, 1988 [EP] European Pat. Off. ..... 88200663

[51] Int. Cl.[5] ..... B25C 1/04

[52] U.S. Cl. ..... 227/8; 227/130; 227/156; 227/120

[58] Field of Search ..... 227/8, 120, 130, 156

[56] References Cited

U.S. PATENT DOCUMENTS

| | | | |
|---|---|---|---|
| 4,736,879 | 4/1988 | Yamada et al. | 227/130 |
| 4,784,308 | 11/1988 | Novak et al. | 227/130 |
| 4,811,882 | 3/1989 | Steeves et al. | 227/8 |

*Primary Examiner*—Paul A. Bell

*Attorney, Agent, or Firm*—Neuman, Williams, Anderson & Olson

[57] ABSTRACT

A fastener driving device of pneumatic type comprises a piston (20) within a cylinder (49), and a driver (21), connected to the piston (20) and movable through a fastener driving throat (26) formed by the housing of the device. A chamber (52) is provided within the housing to function as an air pressure reservoir. First and second valves (15) provide an appreciably lower pressurized air to the underside of the piston (20). The valves (15) are so arranged that when they are in a first position they allow a flow of pressurized air from the reservoir (18) to the underside of the piston (20) and after the pressurized air under the piston (20) increases to a reduced predetermined ratio to that in the reservoir (18), the valves (15) shift to a second position blocking the flow. The valves (15) are capable of shifting to a third position allowing communication of the air pressure under the piston (20) with atmosphere while continuing to block communication with the reservoir.

15 Claims, 9 Drawing Sheets

FIG. 3
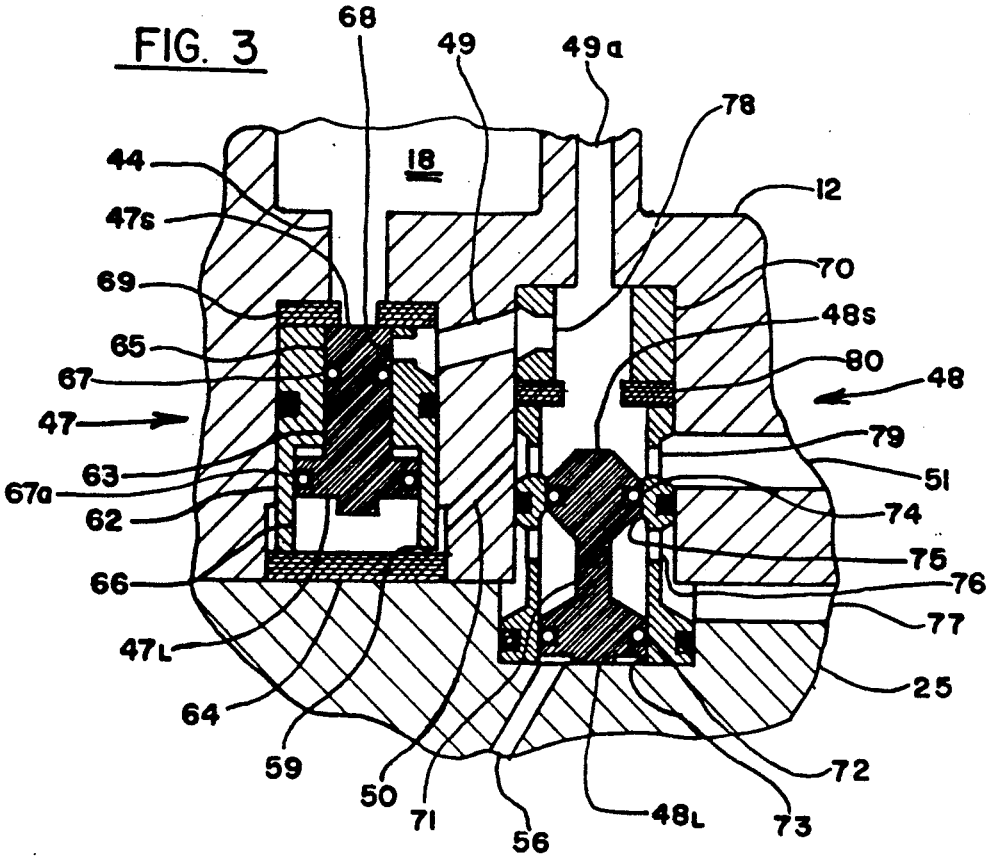
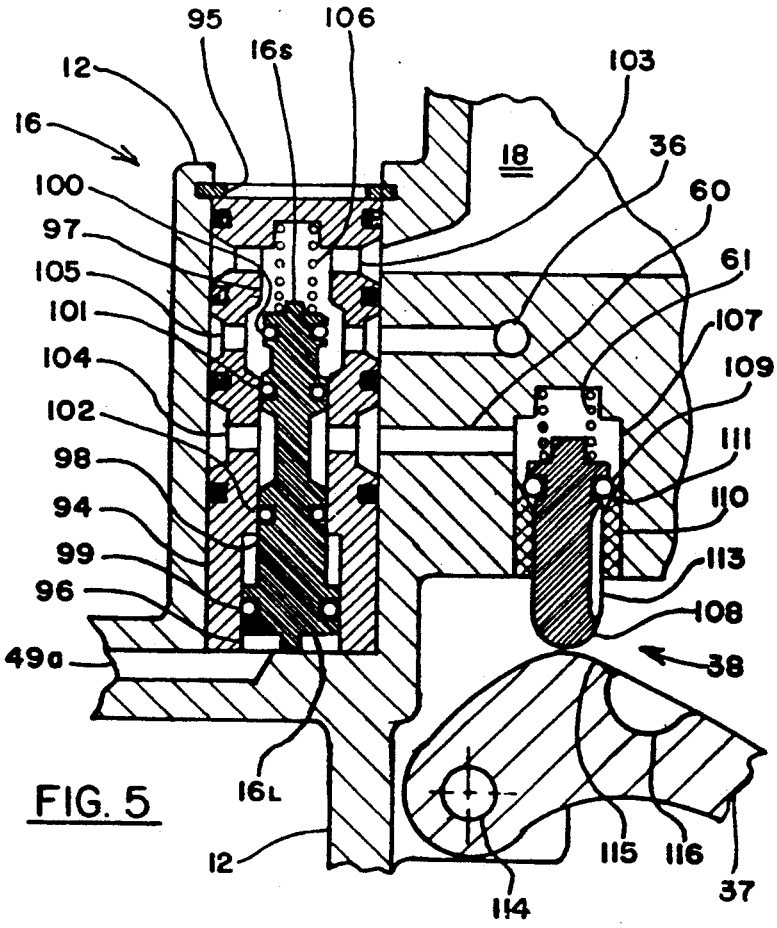
FIG. 5

FIG. 7
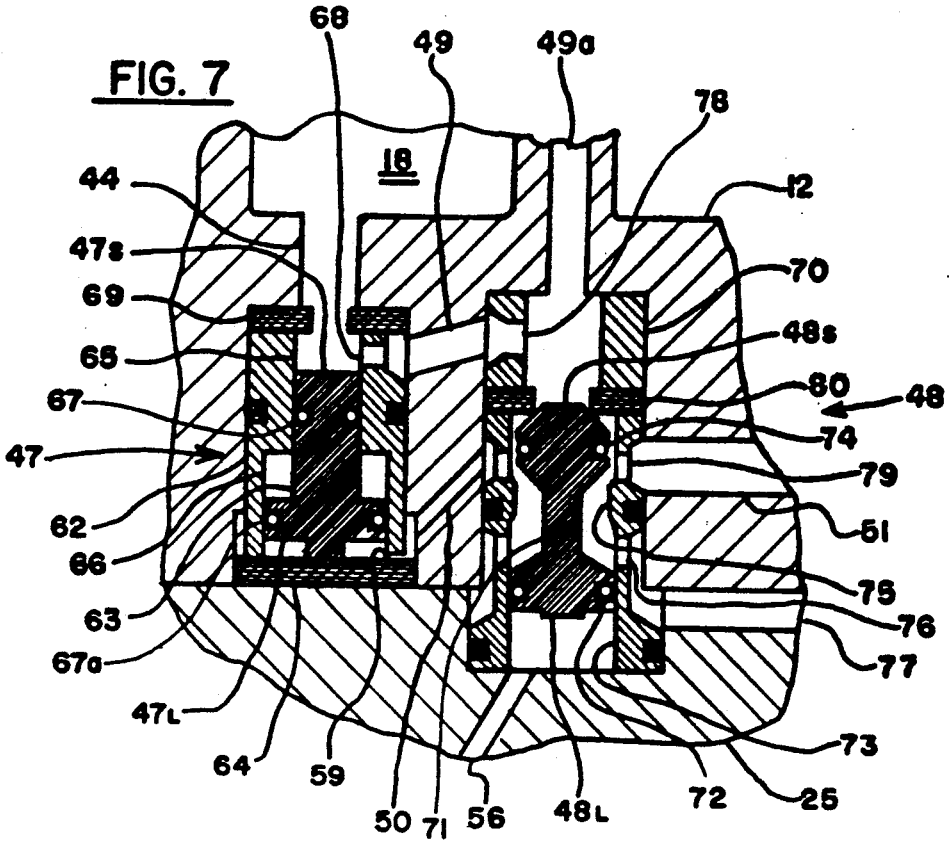
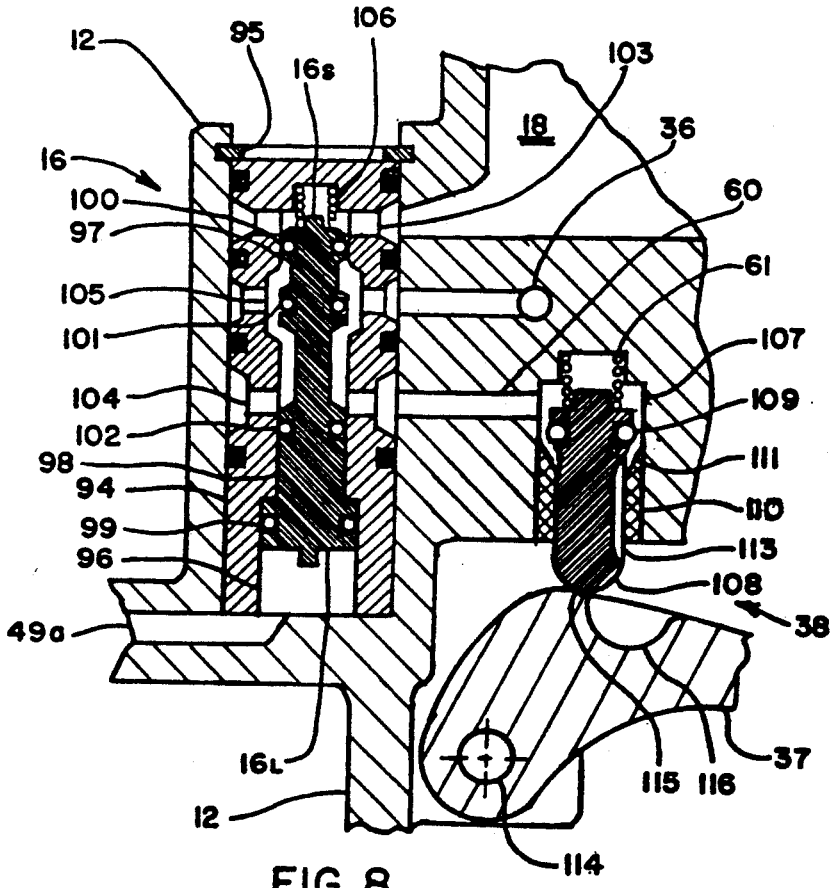
FIG. 8

PNEUMATIC POWERED FASTENER DEVICE

This invention relates to a pneumatic device for driving fasteners and in particular to an improvement in the pneumatic operation of the device.

Powered operated devices for driving fasteners, such as nails, staples, pins and the like, have been used in industrial applications for several years. The fastener range varies from small pins used in furniture to large nails driven into concrete.

In some applications it is possible to mount the device stationary and bring the material to be fastened to the device but in most applications it is required that the driving device be portable.

Portable tools for driving small fasteners are in general rather small since the power needed for driving is not great. Both electric and pneumatic power sources have been utilized in these smaller tools, as the fastener increased in size the power needed to properly drive the fastener also increased thus making the tool larger and heavier.

When designing portable devices human fatigue has to be considered, therefore weight and size becomes a negative feature in such tools.

The use of pressurized air in connection with proper valving can be sized in a much smaller and lighter housing than can an equivalent electrical device, thus compressed air operated portable tools have become dominant in industrial fastener driving devices.

There have also been tools designed to use powder or gas filled cartridges but in general these power sources have a much greater cost per fastener ratio, than that of compressed air.

These cartridge system tools have been successful in applications where the maximum air pressure produced by the available air compressor is limited below that which will properly drive a selected fastener using a conventional pneumatic tool.

Recent developments in pneumatic operated portable tools have lead to providing an air pressure booster built into such tools.

The system allows a readily available air pressure supply to be connected to the tool inlet and the air pressure booster increases the air pressure within the tool to a level necessary for properly driving the fastener. The consumption of air increases of course as the pressure is increased and the driving cost per fastener increases.

Most pneumatic tools also use air to return the piston after each drive stroke. Although high pressure may be needed for the drive stroke the piston return could be accomplished at a much lower pressure. If the means of providing the air for the return stroke could be such that a reduced pressure is used the total air consumption could be reduced and likewise cost per fastener driven ratio would be less.

When used in rapid operation some tools have a design that partially accomplishes this goal. The air for piston return is provided through small holes in the cylinder wall into a reservoir as the piston seal passes these holes during the drive stroke. If the firing valve is released very quickly and the holes in the cylinder are sized correctly the air pressure within the cylinder during the drive stroke will not fully charge the return chamber. Any reduction in air pressure is most inconsistant and in general a consequence of the operators action than the design. The major design factor in these type of tool functions is to assure the piston fully return after each drive stroke. The holes and locations are therefore sized for that purpose and when the tool is operated at normal speed the return chamber is fully charged with the same pressure as that of the driving stroke.

To further reduce the size and weight of heavy duty portable pneumatic fastening tools the return reservoir can be eliminated.

The air in the chamber supplying the drive stroke can be introduced to the underside of the driven piston through a secondary valve system. One such system is described in GB-A-2033286.

The supply air is normally in communication with the underside of the piston through a normal open passageway in a threeway valve.

Prior to operating the trigger the threeway valve is shifted by a rod and linkage means when the tool is placed in contact with the workpiece to be fastened.

The threeway valve closes a port from the supply and opens a second port to atmosphere allowing the pressurized air under the piston to exhaust. Again the air used to return the piston is at the same high pressure as that which is used to drive the fastener. Although tool size has been reduced the air consumption has not been taken into consideration.

The pneumatic function can be further improved by assuring the compressed air under the piston is fully exhausted before the tool will start the drive stroke. Many tools use a work contacting element to prevent the trigger from actuating unless the element is in contact with the workpiece. The same element could also actuate the means to exhaust the air under the piston but there is no certainty the air under the piston has exhausted before the driver moves. Should there be pressurized air under the piston during the drive stroke the driving power will be affected.

Another design factor that must be considered in high pressure tools is the wear and stress on the individual components. The most vulnerable being the element contacted by the underside of the piston at the end of the driving stroke, this item, commonly known as a "bumper" or "piston stop", is usually made from a compressable substance to absorb the energy not used in driving the fastener. Should the tool be operated without fasteners, the bumper will be subjected to the total driving energy and the life of the bumper would be greatly reduced. A means is therefore desirable to prevent the tool from being operated if a fastener is not positioned under the driver.

One example to prevent the tool from operating is to block the trigger movement by a pivotable element that extends into the driving throat. The fastener will push the element out of the way as it enters the driving position and thus unblock the trigger movement. A second example is to use a portion of the component that advances a strip of fasteners toward the driving area to restrict the trigger as the last fastener approaches the area. This second method stops the function before the last fastener is driven and thus all the fasteners can not be driven before reloading the tool.

In both examples there are mechanical components involved that can wear or bind whereas a pneumatic signal eliminates these problems.

Accordingly it is the object of the present invention to provide a means to reduce the consumption of air in a pneumatic fastener driving device by creating different air pressures within the tool for certain functions.

Another object of the invention is to provide a means to return the drive piston at a pressure considerable lower than that of the driving stroke.

Another object of the invention is to provide means to prevent the device from being operable unless a fastener is in proper driving position.

Another object of the invention provides a means to cause a delay between the start of exhausting the air from under the piston and the start of the drive stroke.

Yet another object of the invention is to provide a portable pneumatic fastener device that can be quickly and easily converted from a conventional air powered tool to a device that increases the internal air pressure above that of the air inlet source.

According to the present invention there is provided a portable pneumatic device having a body of which a portion is used as a pressurized air reservoir, a cylinder mounted in the body, a piston slidable in the cylinder, a driver attached to the piston, a valve mounted above the cylinder controlled by a trigger valve means to provide a reciprocal movement of the piston and driver, a fastener guide throat in which the driver moves and a means to introduce fasteners into the guide throat. All the above features are wholly conventional to existing pneumatic fastener driving devices.

In addition the pneumatic system consists of a first valve having one end in communication with the air reservoir and the other end in communication with the underside of the piston, a second valve having one end in communication with a valve means shiftable by a work contacting element, and the other end of the second valve in communication with the first valve.

Both valves are pneumatically double actuated and are unbalanced by having one end larger than the other. High pressure on the small end of the first valve shifts the valve to allow pressurized air to enter the smaller end of the second valve thereby causing the second valve to also shift since the larger end of the second valve is open to atmosphere.

The shifting of the second valve allows communication between the smaller end of the valve and the underside of the piston. The large end of the first valve is also pressurized through a restricted port at the same time and due to the difference in areas on the two ends, the force on the larger end will overcome the force on the smaller end as the pressure increases on the larger end. The first valve will become unbalanced and shift to close off the high pressure air and the air pressure under the piston will remain at a reduced pressure compared to the air pressure in the reservoir. The pressure ratio is dependent on the ratio of the large and small ends of the first valve. By example, if the area on the larger end is four times that of the smaller end, the pressure under the piston would be one fourth that of the reservoir.

To prevent the tool from operating unless it is in the correct position for fastening, a work contacting element extends beyond the fastener exit end of the drive throat that must be depressed, by pushing the end of the element against the workpiece. The movement of the element opens a passageway allowing communication between the reservoir and the large end of the second valve. The second valve shifts blocking the air from the first valve and opening the underside of the piston to atmosphere.

The system described reduces the consumption of air and is but one feature of the present invention. Another feature is to prevent the trigger valve means from functioning until the air pressure under the piston has been greatly reduced. A third valve is also pneumatically double actuated with the smaller end in constant communication with the high pressure reservoir and the larger end in constant communication with the small end of the second valve. The ratio of the area of the ends of the third valve is such that the high pressure on the smaller end prevents the valve from shifting therefore pulling the trigger will not operate the tool prior to actuation of the first and second valves.

As previously described the shifting of the second valve has allowed the underside of the piston to exhaust. Since the large end of the first valve is in communication with the underside of the piston it also begins to exhaust. The passageway through which the air must pass is restricted therefore the pressure on the large end of the first valve decreases at a slower rate than the pressure under the piston.

When the force on the smaller end of the first valve overcomes that of the larger end the valve will shift allowing high pressure air to enter the large end of the third valve. At this time both ends of the third valve are subjected to the same pressure therefore the third valve will shift and allow the trigger means to provide a driving sequence.

An additional safety feature can be accomplished by preventing the second valve from shifting unless a fastener is in the correct driving position in the driving throat. A second passageway is provided between the large end of the second valve and an open port in the driving throat that is positioned to be blocked by the presence of a fastener. Although the port may not be fully closed, a portion of the fastener or a portion of the collation means attached to the fastener will restrict the exhaust of air to allow the pressure on the larger end of the second valve to create enough force to overcome the force on the smaller end. Without the presence of a fastener the pressure will not be enough to shift the second valve therefore the trigger means will not function.

The portion of the body where the air inlet is connected has been enlarged. A plug can be inserted that has an air connector for attaching the air inlet. If the application requires an air pressure higher than that of the inlet source then the plug can be removed and a self-contained air amplifier can be inserted. By having the air amplifier as a self-contained unit servicing and tool downtime can be held to a minimum.

Should there be a malfunction in an air amplifier component the unit can be removed and a spare inserted into the tool thereby keeping the tool in use and the malfunction component can be repaired when time is available. A second advantage is there is no wear on tool components such as the body that would require a major repair and possible expensive replacement and long downtime.

The invention will now be further described by way of the accompanying illustration of which:

FIG. 3 is a cross-section view of a preferred embodiment of the first and second valves along line A—A shown at a normal rest position with air connected to the tool.

FIG. 5 is a cross-sectional view of a preferred embodiment of the trigger valve means.

FIG. 7 is the same as FIG. 3 with the valves shifted to exhaust air from underside of piston.

FIG. 8 is the same as FIG. 5 with the trigger pulled and third valve in operating position.

Figure 1:
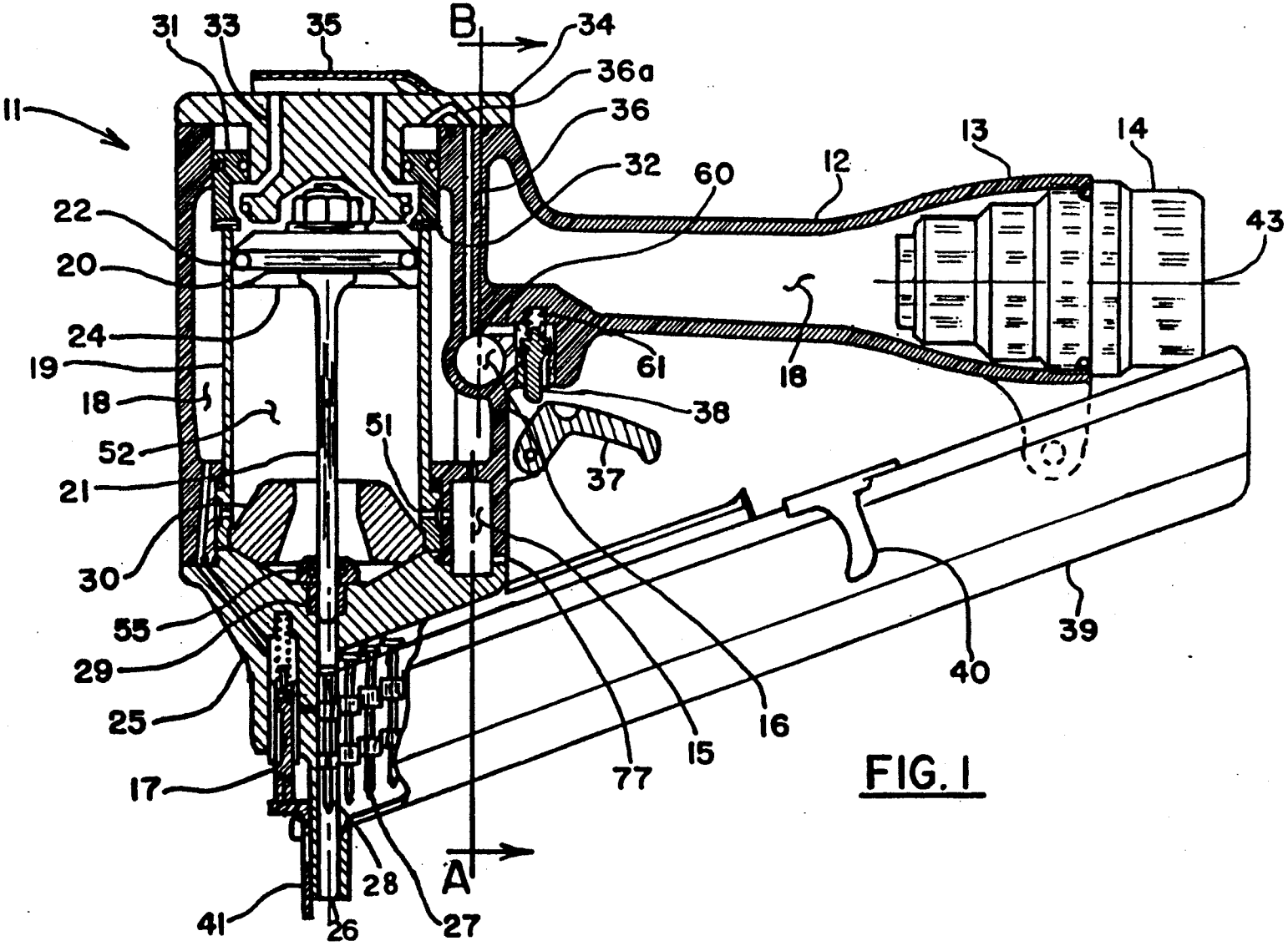
FIG. 1 is a cross section view along the center line of a typical pneumatic fastener driving device with components as a normal rest position.

Referring now to FIG. 1 a pneumatic fastener driving tool, 11, is shown containing all four aspects of the present invention. The body, 12, has an enlarged section, 13, in which is inserted a pressure amplifier, 14, to increase the inlet pressure; a valve means, 15, for controlling the return stroke pressure at a reduced pressure than that of the drive stroke, a valve means, 16, to assure the pressure under the piston is exhausted before allowing a drive stroke, and a control means, 17, to prevent the tool from operating without fasteners.

One embodiment of all of these means, 14, 15, 16 and 17, will be described in detail in later sections.

The tool, 11, has certain components that are wholly conventional in present pneumatic fastener driving devices and are not restrictive upon the present invention. The body, 12, contains a hollow section to be used as an air reservoir, 18.

Within the body is mounted a cylinder, 19, in which a piston, 20, can slide. The driver, 21, is attached to the piston, 20, to enable both to function as a unit. An O-Ring, 22, is used to provide an air seal between the upper, 23, and lower, 24, sides of the piston, 20.

In the lower section of the tool, 11, below the cylinder, 19, there is mounted a guide piece, 25, containing a driving throat, 26, through which the driver, 21, can freely move. The throat, 26, is sized according to the shape of the fasteners, 27, to be driven and one side open for entry of the leading fastener, 28. The upper section of the guide piece, 25, has a bushing, 29, to center the driver, 21, on the drive throat, 26.

A piston bumper, 30, is used to cushion the shock that would occur if the piston, 20, was allowed to strike directly on the lower section of the tool.

Directly above the top of the cylinder, 19, is located a driving stroke valve means, 31, that is shiftable between a closed and open position. In the closed position, as shown in FIG. 1, a seal, 32, blocks the air in the reservoir, 18, from entering the upper section of the cylinder, 19. At the same time the upper, 23, side of the piston is in communication with atmosphere through passageway, 33, located in a cap, 34, attached to the body, 12.

An exhaust air deflector, 35, is provided to direct the exhaust forward away from the operator when the tool is cycled.

Top of the valve, 31, is pressurized by way of passageway, 36, in communication with valve means, 16. The lower portion of valve, 31, is in continuous communication with the reservoir, 18, but since the top is larger than the area of the lower portion, the valve, 31, remains in the closed position. A manually operated trigger, 37, pivots on the body, 12, and when pulled upward lifts the trigger valve, 38, to start the driving sequence.

The fasteners, 27, are normally collated in strip form and guided into the drive throat, 26, by way of a fastener magazine, 39. A pusher, 40, is biased forward to force each consecutive fastener into the drive throat, 26, as the leading fastener, 28, is driven therefrom.

The magazine, 39, as shown in FIG. 1, has been positioned at an inclination to allow clearance above the workpiece but many forms of magazines can be utilized including that designed for fasteners collated in coils. A workpiece contact element, 41, extends below the guidepiece, 25, and must be depressed against the workpiece before the tool, 11, will function.

Although the above described embodiment is preferred the components could be modified considerable depending on the application in which the tool is to be used.

Figure 2:
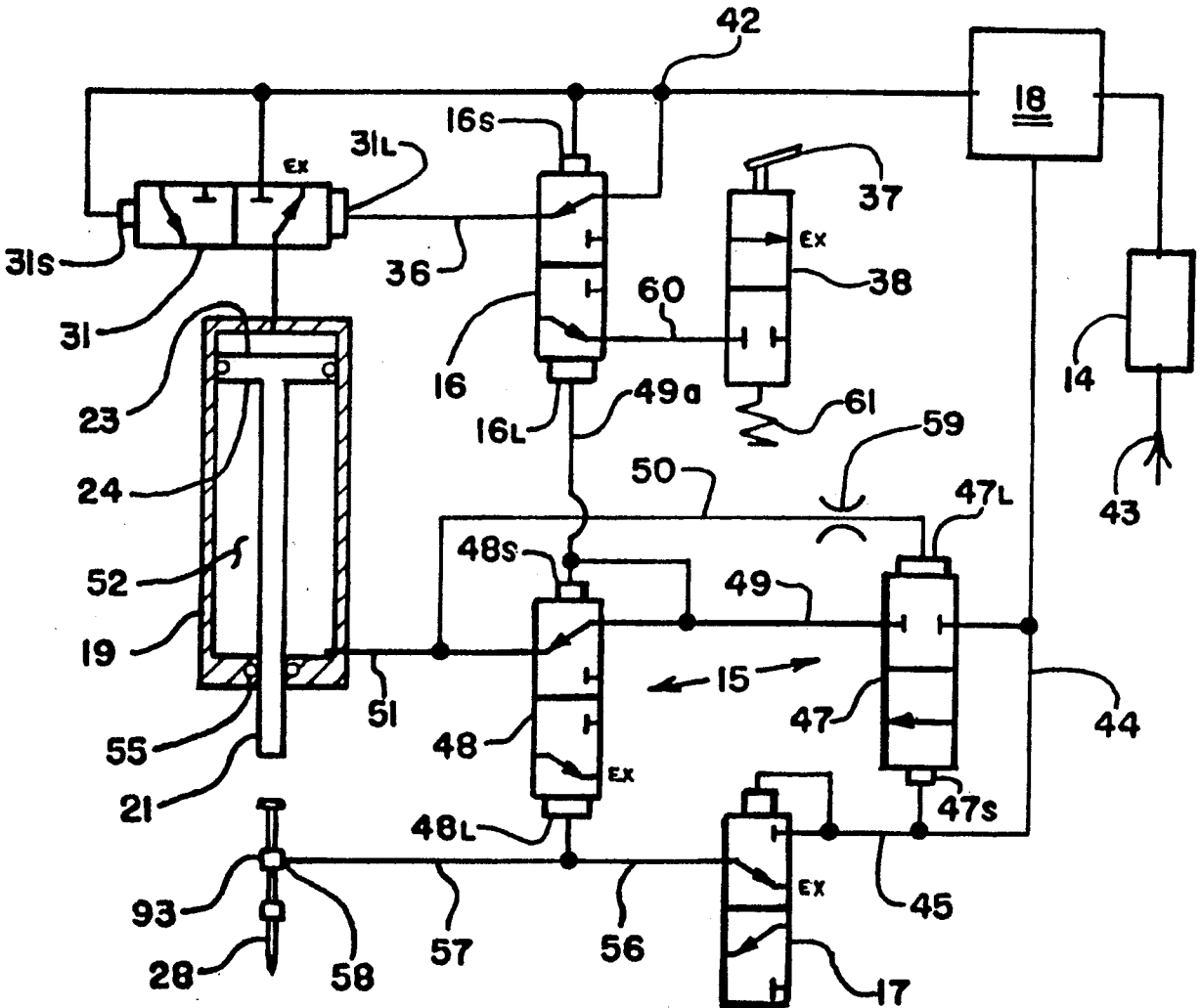
FIG. 2 is a pneumatic schematic showing the valves and passageway communications.

FIG. 2 provides an air flow diagram, in normal "at rest" position, to better understand the complete tool cycle before an embodiment of each component is detailed. The small circles, 42, indicate intersecting air flows. An external pressurized air line inlet source is connected to the tool at inlet port, 43. The pressure amplifier, 14, increases the pressure in the reservoir, 18, and the passageways 36, 44, 45 and 46, above the inlet pressure. Valve means, 15, consist of two separate valves, 47 and 48, interconnect by passageways, 49 and 50.

The valves can be described by standard valving terminology as follows:

- Valve, 16, is a threeway, normally open, double air actuated.
- Valve, 17, is a threeway, normally closed, manual actuated and air return.
- Valve, 31, is a threeway, normally closed, double air actuated.
- Valve, 38, is a twoway, normally closed manual actuated and spring return.
- Valve, 47, is a twoway, normally closed, double air actuated.
- Valve 48, is a threeway, normally open, double air actuated.

The actuating means on all double air actuated valves 16, 31, 47 and 48, consist of a piston type component when subjected to pressurized air will create a force trying to shift the valve. The piston on one end has a large area, L, and the piston on the opposite end has a small area, S; therefore when the same air pressure is applied to each end of the valve the force on the large end, L, will override the force on the small end, S, and hold the valve in its normal position. By example: valve, 31, has the small end, 31S, in continuous communication with the reservoir, 18, and the large end, 31L, has the same pressure provided through passageway, 36.

Since both end have the same pressure the valve, 31, is held in a closed position.

When air pressure is first connected to the tool, 11, with or without the amplifier, 14, passageway, 50, has no pressure, therefore large end, 47S, will shift valve, 47, to an open position providing communication between reservoir, 18, and the underside, 24, of the piston, 20, by way of passageway, 49, valve, 48, and passageway, 51. A closed chamber, 42, within the cylinder, 19, under the piston, 20 has been formed by piston O-ring, 22, (see FIG. 4), O-Ring, 53, 54, and driver seal, 55, except for passageway, 51. Due to normal friction in air passages the pressure within chamber, 52, does not instantaneous reach that in the reservoir, 18, therefore passageway, 50, and large end, 47L, of valve, 47, are pressurized gradually.

As the force created by large end, 47L, increases it will overcome the force created by small end, 47S, and shift the valve, 47, to a closed position thus providing a reduced air pressure within the chamber, 52, compared to that in the reservoir, 18.

The ratio of the air pressure reduction depends on the area ratio between the large end, 47L, and small end, 47S, of valve, 47.

To provide the maximum energy during the drive stroke the air within chamber, 52, must be exhausted prior to the driving sequence. By shifting valve, 48, communication between passageways, 49, and passageway, 51, will be interrupted and passageway, 51, will communicate with atmosphere. Shifting of valve, 48, can be accomplished by depressing workpiece contact element, 41, and have a mechanical linkage actuate valve, 48. A preferred embodiment is to have the shifting done pneumatically therefore valve, 17, is shifted by the depressing element, 41, to an open position providing communication between reservoir, 18, and the large end, 48L, of valve, 48, through passageway, 56.

Tools that operate at high pressure create a very powerful drive stroke and if there is no resistance due to the fastener entering the workpiece damage could occur to internal components especially the bumper. To prevent this possibility a second passageway, 57, provides communication between large end, 48L, and atmosphere. Although large end, 48L, communicates with the reservoir, 18, passageway, 57, will not allow the pressure on large end, 48L, to create enough force to overcome the force created by the small end, 48S, thus valve, 48, will not shift to exhaust the air within chamber, 52. By positioning the end port, 58, of the passageway, 57, that is open to atmosphere within the fastener drive throat, 26, the exhaust air from the port, 58, can be obstructed by the presence of a fastener 28, in the drive throat.

This obstruction can cause a build up of pressure within passageways, 57 and 56, to allow the force on large end, 48L, to overcome small end, 48S, and shift valve, 48. The port, 58, does not have to be completely closed since even a lesser pressure on large end, 48L, will create a greater force than can be created by the small end, 48S, acted upon by pressure in passageway, 49.

To provide the driving sequence, the trigger, 37, is manually lifted to shift valves, 38 and 31. To provide assurance the driving stroke does not start prior to exhausting of the chamber, 52, thus reducing the driving power, an additional valve, 16, is used that interrupts communication between trigger valve, 38, and drive stroke valve, 31. Passageway, **49*a*, is an extension of passageway, 49, providing communication between valve, 47, and large end, 16L, of valve, 16. Air within passageway, 50, has already exhausted along with that in chamber, 52. Force on small end, 47S, shifts valve, 47, to an open position providing communication between passageways, 49, 49*a*, and large end, 16L, which in turn created enough force to override the force created by small end, 16S**.

To assure that valve, 16, does not shift until the pressure within chamber, 52, is nearly that of atmosphere, a restriction, 59, is in passageway, 50, to delay the drop in pressure on large end, 47L, of valve, 47.

Lifting of valve, 38, provides communication between large end, 31L, of valve, 31, and atmosphere by way of passageway, 36, valve, 16, and passageway, 60. When passageway, 36, exhausts valve, 31, shifts to an open position providing communication between reservoir, 18, and the upper side, 23, of piston, 20. The piston, 20, and driver, 21, move downward with a powerful stroke and drives the fastener, 28, into the workpiece. Releasing the trigger, 37, allows a spring, 61, to reseat valve, 38, and break communication between passageway, 60, and the atmosphere but not further valve action takes place and the driver, 21, remains down. When the tool, 11, is lifted from the workpiece the workpiece contacting element, 41, resets allowing valve, 17 to also reset.

Passageway, 56, and large end, 48L, of valve, 48, breaks communication with the reservoir, 18 and establishes communication with atmosphere.

Force from small end, 48S, shifts valve, 48, to an open position again providing communication between the chamber, 52, and the reservoir, 18, through passageways, 51, 49 and valve 47, which had already been shifted to an open position. The force on the under side, 24, of piston, 20, will raise the driver, 21, and piston, 20, toward the upper end of the cylinder, 19.

As the volume within chamber, 52, increases due to the raising of the piston, 20, away from the guide piece, 25, the pressure increases gradually within chamber, 52, passageway, 50 and large end, 47L, of valve, 47. Valve, 47, shifts to a closed position breaking communication with reservoir, 18, while the pressure within chamber, 52, is at a lesser value than that in reservoir, 18, as explained previously.

Referring now to FIGS. 3 and 7, one embodiment of the valve means, 15, to provide a reduced air pressure to the underside, 24, of piston, 20, will be described. It should be understood the passageways are shown in the same plane for clarity whereas in reality they could be located at 90° from each other. Also all O-Rings shown solid black function as static seals to isolate passageways.

Valve, 47, construction consists of a sleeve, 62, mounted in the body, 12, in which a valve spool, 63, can shift from an open position (FIG. 7) to a closed position (FIG. 3). Seal, 64, prevents air leakage between body, 12, and guide piece, 25. The sleeve, 62, has internal concentric small, 65, and large, 66, bores.

Shiftable within the bores, 65 and 66, is the valve spool, 63, which has corresponding diameters to match the bores. O-Rings, 67 and **67*a*, located in grooves on spool, 63, form a seal on bores, 65 and 66, thus creating the previously described small end, 47S, and large end, 47L, of valve, 47**.

A port, 68, intersects bore, 65, and passageway, 49, and between the end of bore, 65, and body, 12, is located a seal, 69, to prevent air leakage between passageways, 44 and 49. Seal, 69, also blocks communication between passageway, 44 and 49, when the valve spool, 63, is in the closed position. A port, 59, is in the lower portion of sleeve, 62, to provide continuous communication between large end, 47L, and passageway, 50. The area of port, 59, is considerable smaller than the area of passageway, 50, therefore the flow of air from large end, 47L, is restricted as previously described.

Valve, 48, construction consists of a sleeve, 70, mounted in the body, 12, in which a valve spool, 71, can shift from an open position (FIG. 3) to a close position (FIG. 7). The valve spool, 71, has an O-Ring, 72, that seals the lower section bore, 73, of the sleeve, 70, to form large end, 48L. The spool, 71, has a second O-Ring, 74, that seals against a center section bore, 75, when the valve is in the open position as shown in FIG. 3. The sleeve, 70, has a port, 76, between the bores, 73 and 75, that intersects a passageway, 77, that is exposed to atmosphere. The sleeve, 70, has a second port, 78, at the upper end to provide an extension, 49*a*, to passageway, 49. Between the center bore, 75, and port, 78, is a third port, 79, that intersects passageway, 50, and passageway, 51. Between ports, 78 and 79, is located a seal, 80, that interrupts communication between ports, 78 and 79, whenever valve spool, 71, is in the close position, as shown FIG. 7, and forms small end, 48S, of valve, 48. The spool, 71, has an intercut section between O-Rings, 72 and 74, to provide rapid flow of air from chamber, 52, when valve, 48, is in the close position.

Valves, 47 and 48, are shown in FIG. 7 after the tool, 11, has driven a fastener and the workpiece contact element still in a depressed state.

The pressure condition is therefore:

Small end, 47S, reservoir pressure

Large end, 47L, atmosphere

Small end, 48S, reservoir pressure

Large end, 48L, reservoir pressure

By lifting the tool, 11, valve, 17, resets allowing air in passageway, 56, and large end, 48L, to exhaust to atmosphere. Valve, 48, will shift downward and O-Ring, 74, will seal against bore, 75, interrupting communication of passageways, 50 and 51, with atmosphere. At the same time chamber, 52, is placed in communication with reservoir, 18, by way of passaways, 44, 49, 51, and ports, 68, 78, 79.

As air enters chamber, 52, the pressure starts to increase, but since there is very little resistance to the movement of the piston, 20, within the cylinder, 19, the piston, 20, starts to return immediately. The raising of the piston, 20, will cause the volume of chamber, 52, to increase and the air pressure within the chamber, 52, could never reach that of the reservoir, 18, until the piston, 20, stops at its full upward position.

The large end, 47L, of valve, 47, is also in communication with the same pressure as the chamber, 52, but since the small end, 47S, is in communication with the reservoir, 18, the valve, 47, will not shift until the pressure acting upon large end, 47L, can create a force greater than the force created by the pressure in reservoir, 18, acting upon small end, 47S.

To minimize the consumption of air need for each cycle of the tool the pressure under the piston must be no greater than that necessary to assure return the piston, 20 and driver, 21, to its full upward position. Even on heavy duty tools this pressure is no more than 2 bar, therefore if the pressure need to provide the necessary driving power was above 8 bar the area ratio between bore, 65, and bore, 66, in valve, 47, could be four to one. Of course this is but a simple example and the ratio may be different for another application. The simplicity of the preferred embodiment of the valve, 47, would easily allow changing from a valve with one ratio to another valve with a different ratio whenever the air pressure needed for driving was changed considerably. Such a case would be when the tool was converted from one using a normal air pressure source by inserting the pressure amplifier, 14.

It is also anticipated the ratio can be altered by only adding a spring to the large end, 47L, to assist the air pressure to cause valve, 47, to shift close. An even further embodiment would be to have the spring force adjustable by way of a screw or other like means.

All of these embodiments as well as others that may be devised by those skilled in the art fall within the teachings of the present invention, wherein valve means, 15, limits the air pressure on the under side, 24, of the piston, 20, to something considerable less than that within the reservoir, 18.

Figure 4:
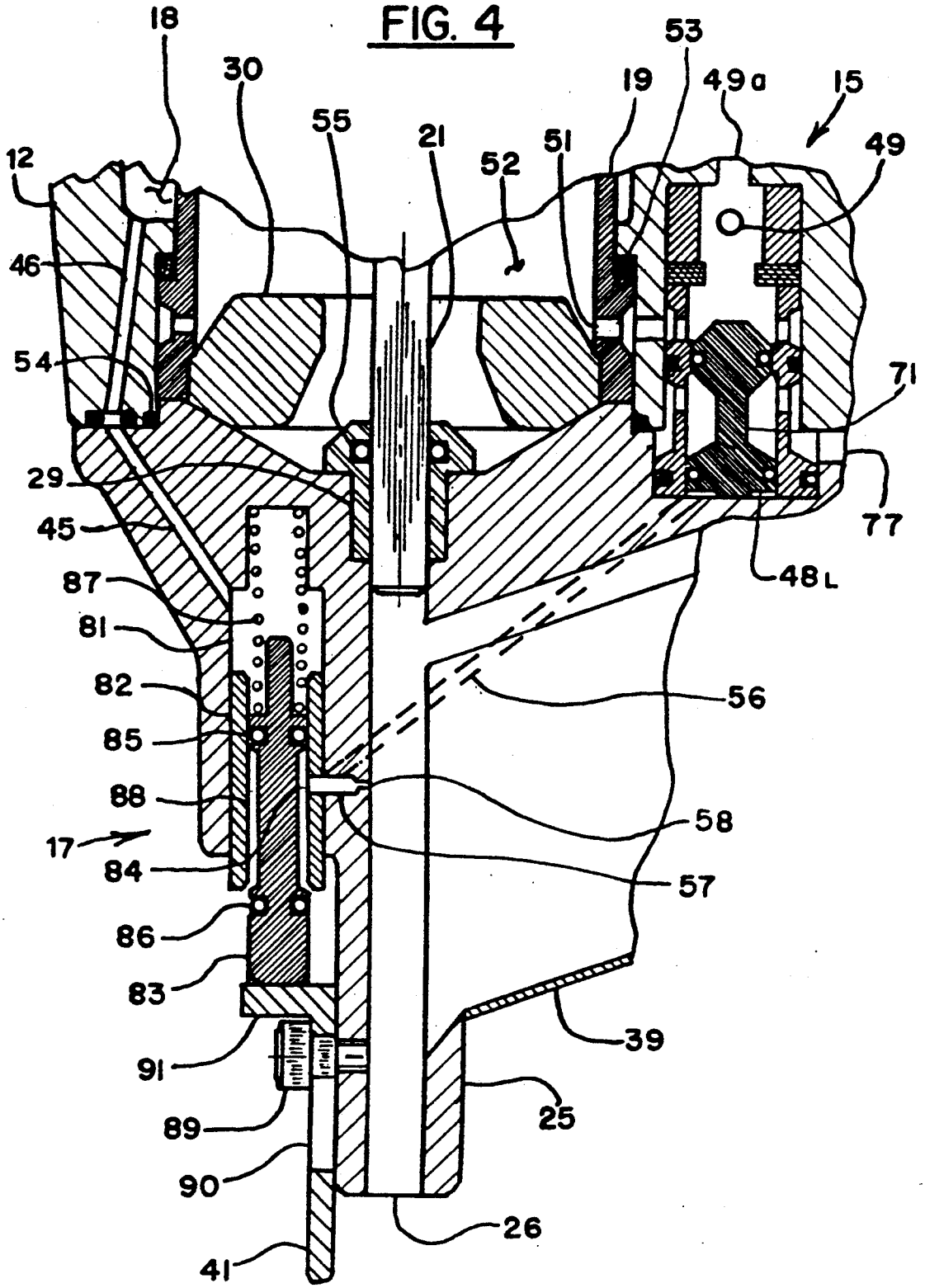
FIG. 4 is a cross-sectional view of a preferred embodiment of the workpiece contact means.
Figure 6:
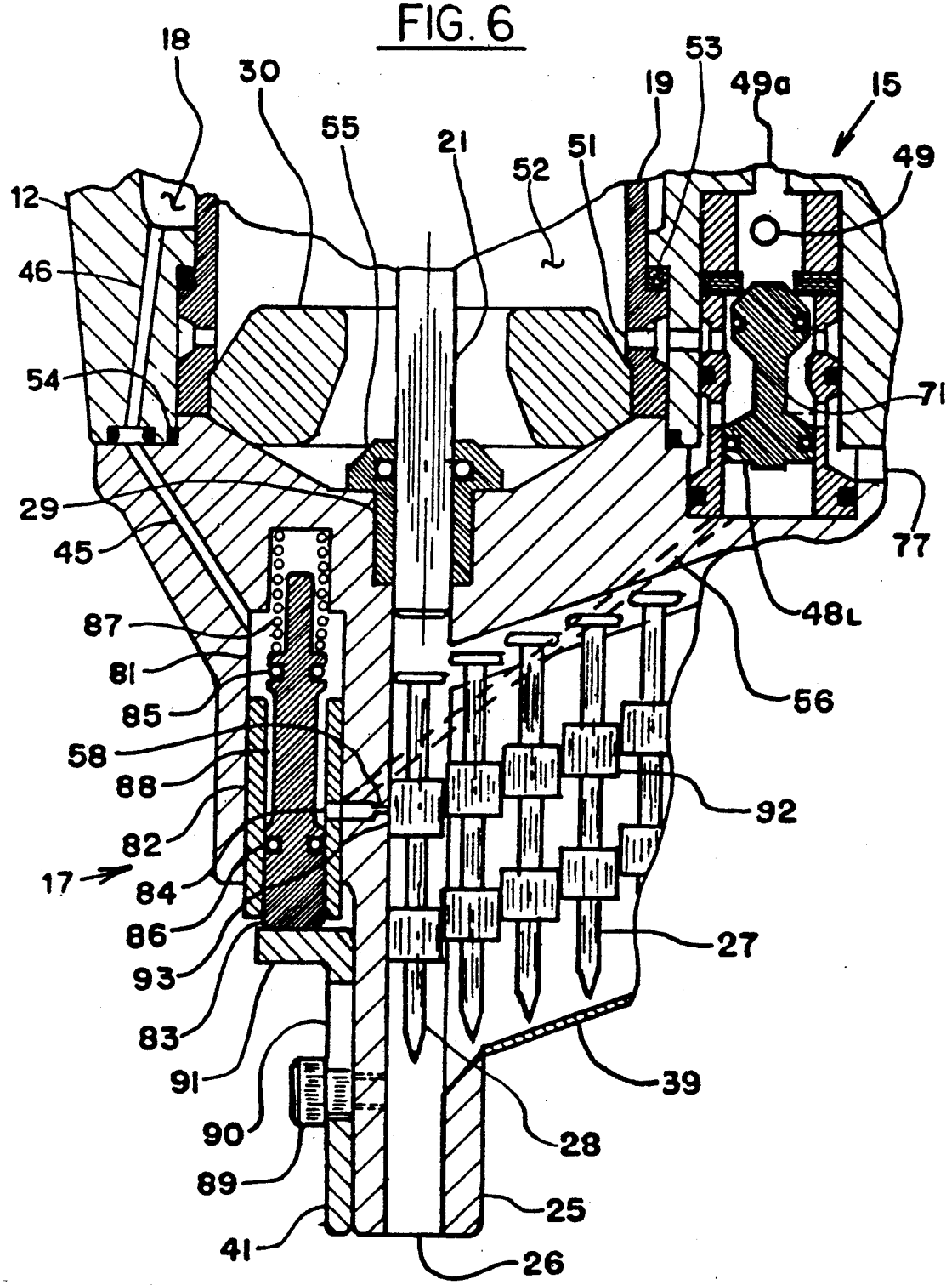
FIG. 6 is the same as FIG. 4 with the workpiece contact means depressed against the workpiece.

Referring now to FIGS. 4 and 6, one embodiment of the workpiece contact means, 17, will be described. The guide piece, 25, contains a bore, 81, in which a bushing, 82, is pressed only for ease of production. A valve steam, 83, can slide within the bushing, 82, from a close position, (FIG. 4) and an open position (FIG. 6). Passageway, 45, intersects bore, 81, and provides continuous communication between bore, 81, and reservoir, 18, by way of passageways, 45 and 46. Port, 84, located in bushing, 82, intersects passageway, 56. The valve stem, 83, contains O-Ring, 85, and O-Ring, 86, spaced apart so as to never cross port, 84, in either close or open position. The O-Ring, 85, is located to prevent communication between bore, 81 and port, 84, and O-Ring, 86, is located to provide communication between port, 84, and atmosphere whenever valve means, 17, is in the closed position (FIG. 4). Spring, 87, is used to assure the valve stem, 83, remain in the close position when there is no air on the tool, 11. During normal operation air pressure on the top of valve stem, 83, could be sufficient for proper operation and undercut portion, 88, on stem, 83, located between O-Rings, 85 and 86, provides free flow of air from port, 84, to atmosphere.

A workpiece contact element, 41, is secured to the guide piece, 25, by a shoulder screw, 89. The element, 41, has a slot, 90, to allow vertical movement between an extended position below the end of guide piece, 25, whenever the tool, 11 is not in contact with the workpiece (FIG. 4) and a flush position with the guide piece, 25, end when the tool is in contact with the workpiece (FIG. 6).

A top portion, 91, shifts the valve stem, 83, upward (FIG. 6) to an open position. Although it is presently preferred to have the element, 41, and stem, 83, separate components it is obvious they could be constructed as a single component or other combinations of components.

Shifting of valve stem, 83, to an open position, as shown in FIG. 6, provides communication between reservoir, 18, and large end, 48L, causing valve, 48, to shift upward thereby exhausting the air in chamber, 52.

To provide the additional safety of preventing the tool driving stroke without a fastener present, a passageway, 57, is introduced.

One end of passageway, 57, intersects passageway, 56, and the other end intersects the driving throat, 26, by way of port, 58. Unless port, 58, is at least partially blocked the air pressure within the bore, 73, will not build up enough to create a force on large end, 48L, to shift valve, 48. The restricting of air flow from port, 58, to build up the pressure can be accomplished by a portion of the fastener covering the port, 58. The fasteners, 27, are normally collated by an elongated element, 92, having a series of holes in which the shank portion of the fastener is located. The collating element, 92, is wholly conventional to the production of collated fasteners and takes on many configurations.

When the leading fastener, 28, is correctly positioned within the driving throat, 26, a portion, 93, of the collating element partially blocks port, 58, providing the build up in pressure in passageway, 56. It is to be noted that in certain applications the fasteners are not collated but are inserted into the driving throat, 26, just prior to driving. In this type of fastener there is an element on the fastener shank to keep it correctly positioned in the driving throat, 26, and the element will function the same as the portion, 93. The driver, 21, will advance and drive the fastener, 28, from the driving throat, 28, but the valve, 48, will not reset because the driver, 21, itself will then partially block port, 58, as long as the driver, 21, is in the down position.

Referring now to FIG. 5 and FIG. 8 one embodiment of the trigger valve, 38, and safety valve, 16, will be described. A valve sleeve, 94, is mounted in the body, 12, using O-Rings, shown as solid black circles as seals to isolate passageways, 36, 49*a*, 60 and reservoir, 18. The sleeve is retained in the body, 12, by lock ring, 95.

The sleeve, 94, contains the large bore, 96, concentric to a small bore, 97. Within the sleeve, 94, is a valve spool, 98, having a large and small diameter to correspond to the large, 96, and small, 97, bores of the sleeve, 94. At one end of spool, 98, is an O-Ring, 99, to seal against bore, 96, to form large end, 16L, and on the other end is an O-Ring, 100, to seal against bore, 97, to form small end, 16S.

Located on the valve spool, 94, intermediate the O-Rings, 99, and 100, are O-Rings, 101 and 102, both of which also seal against bore, 97. The valve spool, 94, has a first recess area between O-Ring, 100 and 101, and a second recess area between O-Rings, 101 and 102, to provide free flow of air.

The sleeve, 94, has a first port, 103, to provide continuous communication between reservoir, 18, and end of bore, 97. A second port, 104, intersects passageway, 60, and intermediate ends of bore, 97.

A third port, 105, intersects passageway, 36, and bore, 97, intermediate port, 103, and port, 104. Bore, 97, has an undercut located in area of port, 105, to break the seal between O-Ring, 100, and bore, 97, when valve, 16, is in an open position (FIG. 5) and to break the seal between O-Ring, 101, and bore, 97, when valve, 16, is in a close position (FIG. 8). A spring, 106, is used to keep valve spool, 98, in the open position (FIG. 5) when there is no air connected to the tool.

Area of large end, 16L, is only slightly more than area of small end, 16S, to assure that when large end, 16L, is in communication with chamber, 52, the force will not be greater than the force created by small end, 16S, in communication with reservoir, 18, but will override force of small end, 16S, and spring, 106, whenever the large end, 16L, is also in communication with reservoir, 18.

The trigger valve means, 38, consists of a bore, 107, in the body, 12, intersected by passageway, 60. Within bore, 107, is a valve stem, 108, containing an O-Ring, 109. Bushing, 110, is fixed into body, 12, concentric to bore, 107, with the top surface, 111, providing a seal area for O-Ring, 109. Spring, 61, resets O-Ring, 109, when trigger, 37, is released. Recess, 113, provides free flow of air to atmosphere from bore, 107, when O-Ring, 109, is raised forming the large end, 31L, of valve, 31. The passageway, 36*a*, within the head, 119, is a continuation of passageway, 36, and intersects a cavity, 123, formed by the head, 119, top of component, 117, and O-Ring, 118, 122. On the lower portion of component, 117, is mounted the seal, 32, that provides communication between the reservoir, 18, and the upper side, 23, of piston, 20, whenever the valve, 31 is in an open position (FIG. 9), and interrupts communication when valve, 31, is in a close position (FIG. 1).

Passageway, 33, intersects cylindrical surface, 120, between O-Ring, 121, and the area contacted by O-Ring, 122, located on component, 117, and the external portion of the head exposed to atmosphere.

O-Ring, 121, mounted on the lower portion of the head, 119, provides a seal with an internal cylindrical surface, 124, of component, 117, when valve, 31, is in an open position (FIG. 9) to interrupt communication between the upper portion of the cylinder and atmosphere. An undercut, 125, on the interior surface, 120, provides free flow of air around O-Ring, 121, when valve, 31, is in the close position (FIG. 1) allowing the air used to drive the piston, 20, downward to exhaust to atmosphere during the return stroke.

The body, 12, has an expanded portion, 13, in which a plug (not shown) is threaded to provide an air inlet connection means, 43. O-Ring, 126, seals the reservoir, 18, from atmosphere. When the application requires greater power than can be accomplished by the normal inlet source pressure the plug can be removed and a pressure amplifier, 14, can be inserted. The amplifier, 14, has its thread to match that of the body, 12, and sealed to the expanded section, 13, with O-Ring, 126.

The end exposed to reservoir, 18, has a port, 128, through from surface, 111.

Trigger, 37, is attached to the body, 12, by pivot pin, 14, and has a surface, 115, that will shift the trigger valve, 38, to an open position (FIG. 8) whenever the trigger, 37, is pulled upward.

In many pneumatically operated tools the trigger can be held and the tool cycled by only "bumping" the tool against the workpiece to provide a rapid firing mode. In heavy duty applications, such as nailing into concrete, the tool must be held straight and secure to assure correct fastening. To prevent the possibility of "bump" cycling the trigger, 37, has a recess, 116, that will allow the valve stem, 108, to be released when trigger, 37, is pulled upward to its maximum rotation.

To operate the drive cycle it is only necessary to lift the valve stem, 108, momentary to shift drive valve means, 31, as long as valve, 16, has already been shifted to a closed position (FIG. 8). Should the operator hold the trigger, 37, pulled prior to operation of exhausting of the air from chamber, 52, the trigger, 37, must be released and pulled again.

Figure 9:
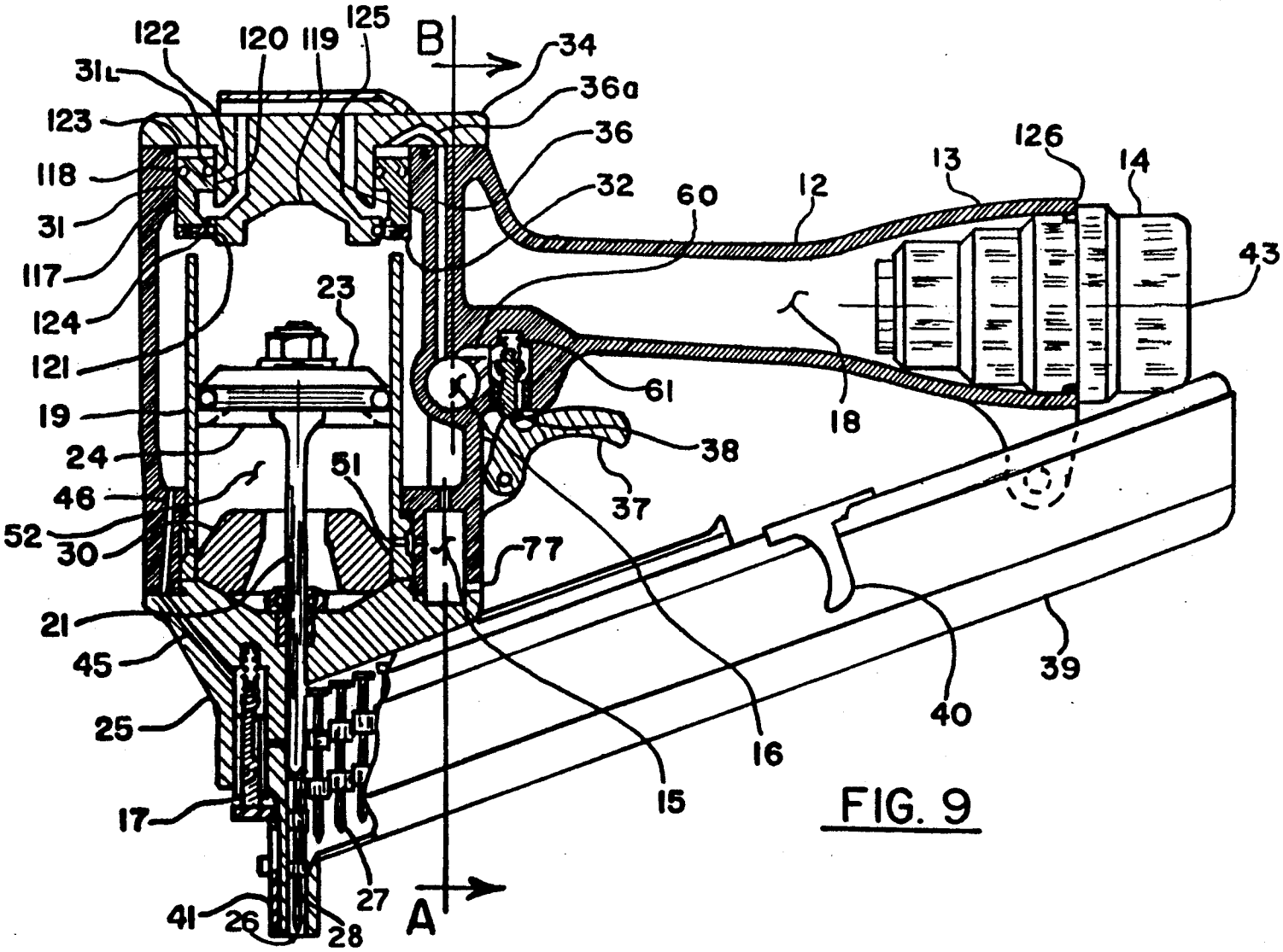
FIG. 9 is the same as FIG. 1 with all components shifted and drive stroke in motion.
Figure 10:
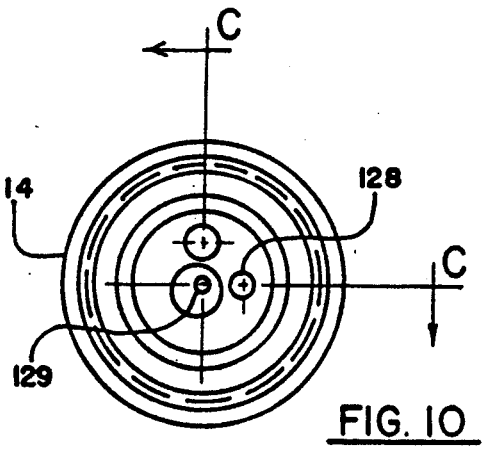
FIG. 10 is an end view of the pressure amplifier.

Drive valve, 31, design is wholly conventional to a particular pneumatic operated fastening tool, but must be pneumatically shiftable by exhausting one section to provide the shifting thereof. One such embodiment is shown in FIG. 1 and FIG. 9. A hollow cylindrical component, 117, is mounted in the body, 12, above the top of cylinder, 19, with an external O-Ring, 118, to form a seal therewith. The head, 34, is mounted to the body, 12, and has a portion, 119, extending into the hollow section of component, 117. Head portion, 119, has a cylindrical surface, 120, and an O-Ring, 121, mounted at the end of the portion, 119. An O-Ring, 122, is mounted on the interior hollow section of component, 117, to form a seal against surface, 120, thereby which the high pressure enters the reservoir, 18, and a second port, 129, through which the air within reservoir, 18, can exhaust whenever the air inlet source is removed from the tool. For production conveniency the ports, 128 and 129, as well as other internal ports are positioned at 90° although it is not necessary to accomplish the object of the present invention.

Figure 11:
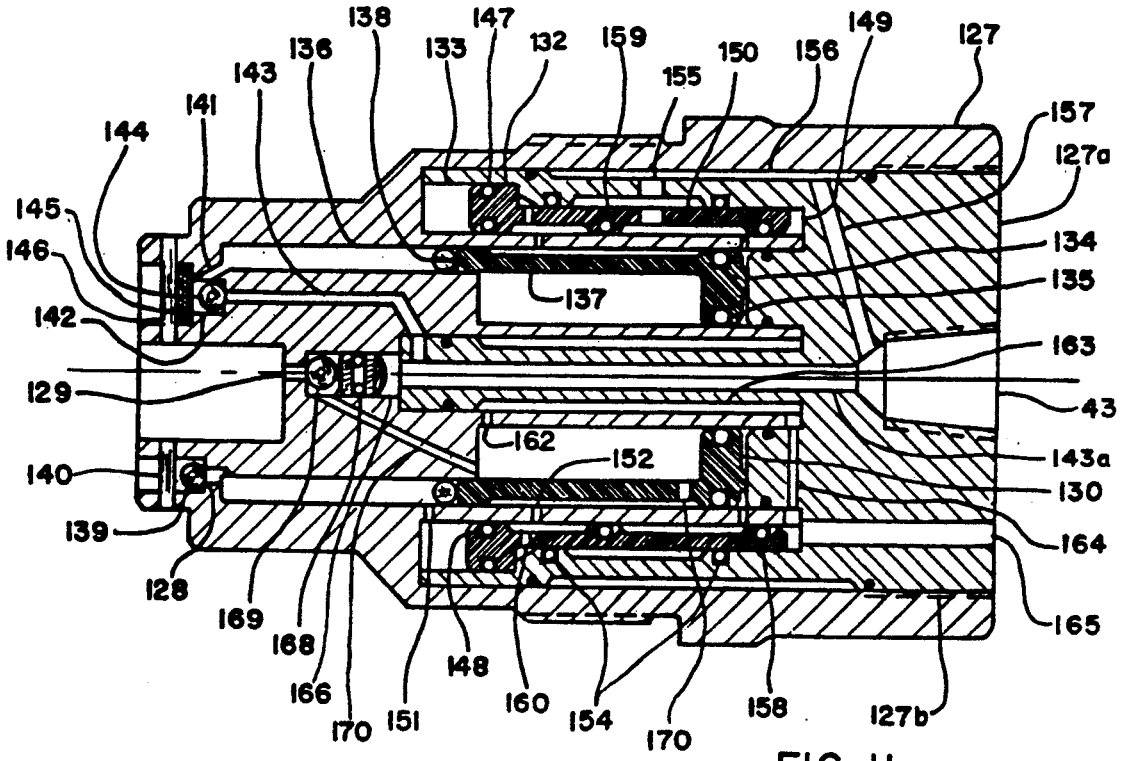
FIG. 11 is a cross-sectional view of a preferred embodiment of the pressure amplifier along line C—C when air inlet source is first connected to the tool.
Figure 12:
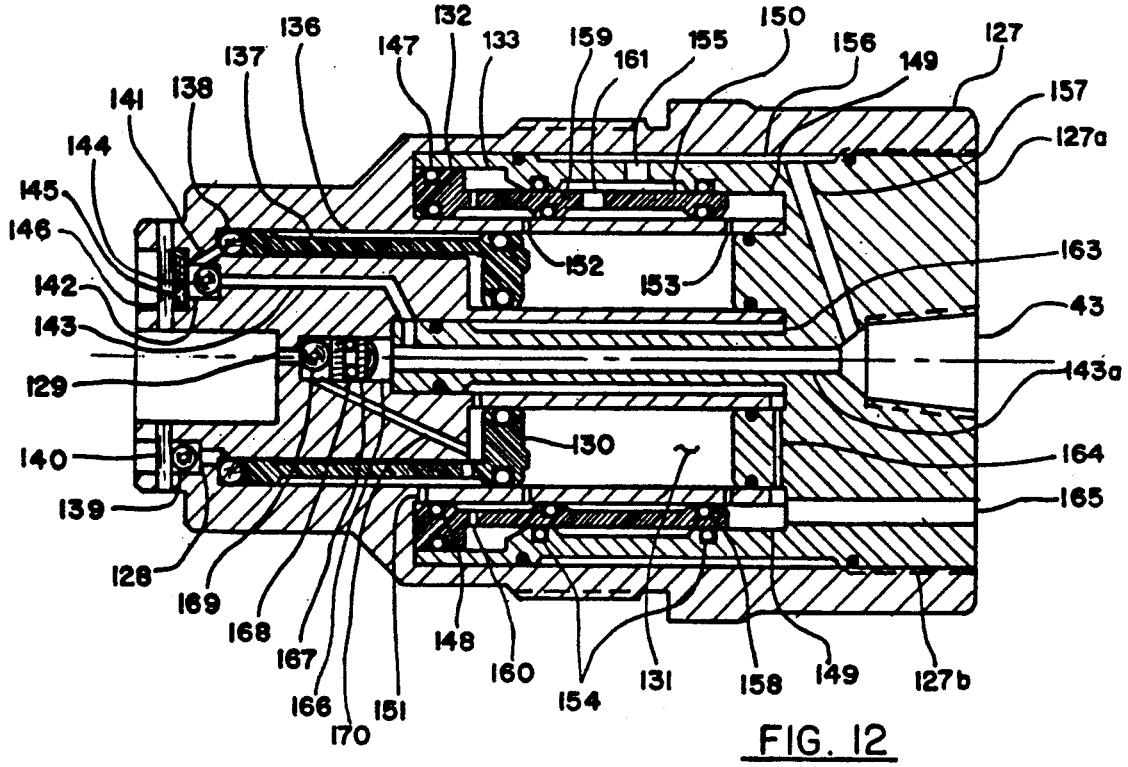
FIG. 12 is the same as FIG. 11 with piston at full stroke and valve shifted to start the piston return stroke.

Referring now to FIG. 11 and FIG. 12 the internal construction of the amplifier, 14, will be described. The amplifier, 14, consists of a housing, 127, and an insert, 127*a*, attached by thread, 127*b*, to form a unit in which the components are contained needed to increase the inlet pressure. The O-Rings shown as black circles are used as static seals to isolate the passageways.

The amplifier, 14, is a self contained unit without need of any external components other than the inlet source connected to inlet, 43, and a sealed reservoir, 18, in which to hold the increased air pressure. The piston, 130, and valve, 132, and the respective chamber, 131, and chamber, 133, in which they have reciprocal motion, are all cylindrical about the centerline of the unit. Piston, 130, contains an external O-Ring, 134, that seals against the outer wall of the chamber, 131, and an internal O-Ring, 135, that seals against the inner wall of chamber, 131. Chamber, 136, is an extension of chamber, 131, but having a considerable reduction in volume. The piston, 130, has a cylindrical extension, 37, sized to be able to move within chamber, 136. An O-Ring, 138, seals on both walls of chamber, 136, thus when pressure is applied to the top of piston, 130, and moves the O-Ring, 138, to reduce the volume in chamber, 136, the air within will increase in pressure.

The end of the unit exposed to reservoir, 18, contains a ball type check valve means in which a ball, 139, seals against port, 128, that is in communication with the end of chamber, 136, when the pressure within reservoir, 18, is greater than the pressure within chamber, 136.

As the pressure within chamber, 136, is increased, by movement of the piston, 130, the ball, 139, will be forced away from port, 128, and the high pressure air within chamber, 136, will flow into the reservoir, 18, thus increasing the air pressure within reservoir, 18. As the piston, 130, returns and the volume of chamber, 136, increases, the pressure within chamber, 136, is the same as the inlet pressure and the ball, 119, reseats closing port, 128, to prevent the flow of air from the reservoir, 18, back into chamber, 136. A retaining pin, 140, limits the movement of ball, 139, away from to assure proper sealing.

The lower end of chamber, 136, has a second type ball check valve means in which a second port, 141, intersects a cavity, 142.

Passageway, 143, also intersects cavity, 142, and an extension, 143*a*, of passageway, 143, provides communication with air inlet source. A ball, 144, is contained within cavity, 142, and seals against the end of passageway, 143, when air pressure within chamber, 136, is greater than inlet source. A seal, 145, and retaining pin, 146, keeps ball, 144, within cavity, 142, and prevents flow of air within reservoir, 18, into cavity, 142.

The valve, 132, contains an external O-Ring, 147, that seals against the outer wall of chamber, 133, and an internal O-Ring, 148, that seals against the inner wall of chamber, 133. Chamber, 149, is an extension of chamber, 133, along the inner wall but has a lesser outside diameter. A portion, 150, of valve, 132, also has a lesser outside diameter to allow movement of portion, 150, within chamber, 149.

The inner wall of chambers, 133 and 149, has 3 ports, with first port, 151, intersecting chamber, 136, below O-Ring, 138, when O-Ring, 138, is in retracted position (FIG. 11). The second port, 152, intersects chamber, 131, at a position above O-Ring, 135, when piston, 130, is in compressed position as shown in FIG. 12. The third port, 153, intersects chamber, 131, above O-Ring, 135, when piston, 130, is in retracted position (FIG. 11). The outer wall of chamber, 149, has a port, 155, intermediate the ends communicating with air inlet source by way of passageways, 156 and 157. An undercut in the outer wall of chamber, 149, in the area of port, 155, is isolated by O-Rings, 154.

The valve, 132, has a second internal O-Ring, 158, located on the opposite end of O-Ring, 148. A third O-Ring, 159, is located intermediate O-Rings, 148 and 158. The portion, 150, of valve, 132, has a first port, 160, between O-Rings, 148 and 159, and a second port, 161, between O-Rings, 159 and 158. Only ports, 151, 152 and 153, are crossed by O-Rings and all other ports, 155, 160 and 161, serve only as a passageways. The portion of the chamber, 131, under the piston, 130, is in continuous communication with atmosphere, by way of port, 162, passageways, 163, 164 and 165. To provide a means to exhaust the reservoir, 18, when the air inlet source is removed from the tool, a cavity, 166, is located between, and intersected by, passageway, 143*a*, and port, 129. Located within the cavity, 166, is a small piston, 167, and O-Ring, 168, acted upon by inlet pressure. Also located in cavity, 166, between piston, 167, and port, 129, is a ball, 169, which is forced in a sealing position against port, 129, by the piston, 167. When the air inlet source is removed from the tool the ball, 169, is forced to a non seal position with port, 129, and reservoir, 18, is in communication with chamber, 131, under the piston, 130, by way of passageway, 170, and in turn communicates with atmosphere to exhaust the air within reservoir, 18.

Referring to FIG. 11, when the air inlet is first connected to the tool at inlet, 43, passageways, 143*a* and 143, are pressurized forcing ball, 144, away from end of passageway, 143.

Cavity, 142, and the chamber, 136, are also pressurized. Since reservoir, 18, has only atmosphere pressure at this time ball, 139, moves away from port, 128, allowing air to enter reservoir, 18, thus increasing the pressure within reservoir, 18, to that of the inlet source very rapidly. Pressure on small piston, 167, holds ball, 169, in a sealing position against port, 129. Chamber, 133, is also pressurized by way of port, 151, holding valve, 131, in a retracted position.

The internal surface of valve, 132, between O-Rings, 158 and 159, is continuously pressurized by way of ports, 161, 155, and passageways, 156, 157. Air enters the chamber, 131, above piston, 130, through port, 153, and piston, 130, moves forward causing extension, 137, to push O-Ring, 138, forward reducing the volume in chamber, 136. As the volume in chamber, 136, decreases the air within will increase in pressure to resist the movement of the piston, 130. Since the area of chamber, 130, is greater than the area of chamber, 136, the pressure within chamber, 136, will increase to the same ratio above the inlet pressure as the inverted ratio of the areas of piston, 130, to piston, 136. By example: if the area of piston, 130, is 2.5 time that of chamber, 136, then the pressure within chamber, 136, will reach 2.5 times that of the inlet pressure before the piston, 130, will stall out in a balanced state.

Referring now to FIG. 12 it can be seen as an O-Ring, 138, passes port, 151, the chamber, 133, exhausts through a port, 170, in the extended portion, 137, of piston, 130, but no shifting of valve, 132, takes place since the end of portion, 150, is also open to exhaust.

When the pressure increases within chamber, 136, to that within reservoir, 18, the ball, 139, will no longer form a seal against port, 128, and the air within chamber, 136, can be forced into the reservoir, 18. As the piston, 130, moves the external O-Ring, 134, passes the port, 152, in external wall of chamber, 131, pressurized air enters chamber, 133, between O-Rings, 147, 148, 154 and 159. Since O-Rings, 148 and 159, seal against the same surface the opposite forces are equal, but O-Ring, 147, seals against outer surface of chamber, 133 and O-Ring, 154 seals against a surface having a lesser diameter, there is a resulting force to shift the valve, 132.

The O-Ring, 158, passes port, 153, providing a passageway to exhaust the air within chamber, 131. The force against O-Ring, 138, starts the piston, 130, return and since the air within cavity, 142, is now the same as the inlet source the ball, 144, breaks the seal with the end of passageway, 143. Inlet air will fill chamber, 136, as the piston, 130, and O-Ring, 138, continue the return stroke.

As O-Ring, 134, passes port, 152, on the return stroke, the chamber, 133, between O-Rings, 147, 148, 154 and 159, exhaust by way of port, 170, in the piston extension, 137, port, 162 and passageways, 163, 164, 165.

Figure 13:
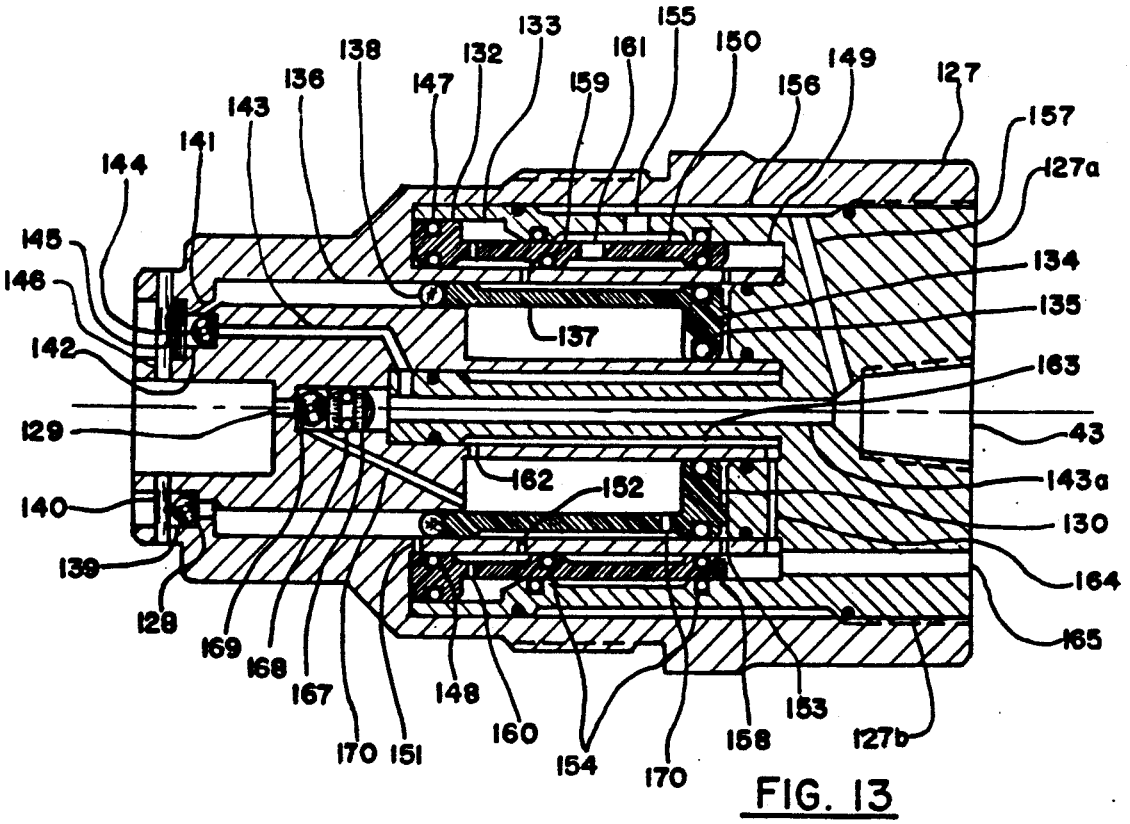
FIG. 13 is the same as FIG. 12 with the piston at full return stroke.

Referring now to FIG. 13 the piston, 130, has completed the full return stroke and O-Ring, 138, has passed port, 151. Air enters chamber, 133, and forces the valve, 132, to the retracted position as shown in FIG. 11. The top of the piston, 130, is again pressurized and the cycle is repeated. The cycling will continue until the air pressure within reservoir, 18, increases to the maximum that can be created within chamber, 136.

Upon each operation of the driving cycle of the tool the consumption of air needed to produce the driving stroke will cause a reduction in pressure within reservoir, 18, permitting the piston, 130, to advance for enough to allow O-Ring, 134, to pass port, 152, which will start again the amplifier, 14, functioning, thus building the pressure within reservoir, 18.

I claim:

1. A pneumatically powered fastener driving device comprising in combination a housing, a cylinder within said housing, a piston within said cylinder, a driver connected to said piston, a driving stroke means providing pressurized air to the upper side of said piston, a portion of said housing forming a driving throat through which said driver can move, means for inserting a fastener into said driving throat, a chamber within said housing to function as an air pressure reservoir, characterized in that it further comprises return stroke means providing an appreciably lower pressurized air to the underside of said piston, said return stroke means when in a first position allowing a flow of pressurized air from said reservoir to said underside of piston, after said pressurized air under said piston increases to a reduced predetermined ratio to that in said reservoir said return stroke means shifting to a second position blocking said flow, said return stroke means being capable of shifting to a third position allowing communication of said air pressure under the piston with atmosphere while continuing to block communication with said reservoir.

2. A fastener driving device as defined in claim 1 in which said return stroke means comprising a first and second valve, when said return stroke means is in said first position said first valve provides a first passageway allowing communication between said reservoir and a second passageway in communication with said second valve, said second valve provides a third passageway allowing communication between said second passageway and said underside of piston, said first valve being pneumatically operated further comprises firstly a small end continually communicating with said reservoir, secondly a large end continually communicating with said underside of piston, the area of said large end when acted upon by said lower pressurized air under said piston will create a greater force than the force created by the air pressure within said reservoir acting upon the area of said small end causing said first valve to shift blocking said first passageway thereby maintaining said second and third passageways at said lower air pressure.

3. A fastener driving device as defined in claim 1 in which said return stroke means is shifted to said third position by a work contacting means acting upon said second valve whenever said work contacting means is forcedly in contact with a workpiece.

4. A fastener device as defined in claim 3 in which said second valve is pneumatically shifted and said work contacting means further comprises a first passageway allowing communication between said reservoir and a port in said second valve to provide said pneumatic shifting, a second passageway allowing communication of said port with atmosphere, a movable portion blocking said second passageway when said movable portion is in said forcedly contact with said workpiece and said movable portion blocking said first passageway when not in contact with said workpiece.

5. A fastener driving device as defined in claim 4 in which said movable portion comprises a first element for preforming said blocking functions and a second element for contacting said workpiece, said first and second elements being integrally operable.

6. A fastener driving device as defined in claim 4 in which said work contacting means further comprises a third passageway providing communication of said port with atmosphere, said third passageway having an opening into said driving throat, to provide said communication with atmosphere, said opening being positioned to be at least partially blocked by the presence of a portion of said fastener or a portion of a material attached to said fastener whenever said fastener is correctly positioned in said driving throat for driving therefrom.

7. A fastener driving device as defined in claim 1 in which said driving stroke means comprises a pneumatically operated first valve means disposed at one end of said cylinder for movement between open and closed positions with respect thereto, a second valve means mounted on said housing for controlling the movement of said first valve, said second valve means further comprising a pneumatically operated servovalve having a small end continually communicating with said reservoir, a large end continually communicating with said second passageway, the area of said large end when acted upon by said lower pressurized air within said second passageway will not create a force great enough to overcome the force created by the airpressure within said reservoir acting upon the area of said small end, shifting of said return stroke means to said third position also allows communication of said large end of said first valve with atmopshere, first valve shifts to restablish communication of said first and second passageways with said reservoir, said servovalve having equal air pressure on both said small and large ends thus shifts providing movement of said pneumatically operated first valve means of said driving stroke means to said open position.

8. A fastener driving device as defined in claim 7 in which said driving stroke means comprises in addition to said first valve means and said servovalve a trigger valve means, said trigger valve means further comprising a first passageway through which said pneumatically operated first valve means communicates with said servovalve, a second passageway through which said servovalve communicates with atmosphere, an element positioned within said second passageway blocking same until said element is manually moved.

9. A pneumatic fastener driving device having a body and comprising within said body a cylinder, a piston and driver combination slidable within said cylinder, valve means for providing reciprocal movement of said piston and driver combination, trigger means controlling said valve means, a cavity to function as an air pressure reservoir and having an end portion, coupling and sealing means within said end portion, said fastener driving device further comprising an air pressure amplifier unit having a housing removably insertable in said end portion of said cavity and having a complementary coupling means to cooperate with said coupling and sealing means within said end portion for holding said unit in said end portion in a sealed manner, said housing of said unit having at its outer end an air inlet connection means for connection to a compressed air source and having at its inner end a high pressure air inlet port communicating with said reservoir, said air inlet port being controlled by a check valve means to allow air flow from said unit to said reservoir, and said housing of said unit at its inner end having further a second port to allow air within said reservoir to exhaust whenever said compressed air source is removed from said air inlet connection means.

10. A pneumatic fastener driving device as defined in claim 9 in which said air amplifier further comprises a housing unit, a means for connecting an air inlet source, said housing unit containing a first chamber, a piston having reciprocal movement, within said first chamber, a second cylindrical chamber concentrical to said first chamber, a cylindrical tube slidable within said second chamber, a first valve means providing said reciprocal movement of said piston and said tube, a second valve means providing an enclosed volume within second chambers, movement of said cylindrical tube in one direction within said second chamber reduces said enclosed volume thus increasing the air pressure therein, said second valve means providing communication between said second chamber and said reservoir whenever said air pressure within said second chamber becomes greater than the air pressure within said reservoir and blocks said communication when pressure within said second chamber is less than pressure within said reservoir.

11. A pneumatic fastener driving device as defined in claim 10 wherein said cylindrical tube and said piston are integral.

12. A pneumatic fastener driving device as defined in claim 10 wherein said first valve means further comprises a third cylindrical chamber concentrical to said first chamber, a shiftable valve sleeve within said third chamber when in a first position providing communication between said inlet source and the upper side of said piston providing a power stroke of said piston and said tube in said volume reducing direction, means to shift said valve sleeve to a second position that provides communication between said upper side of said piston and atmosphere providing a return stroke, a third valve providing communication between said inlet source and said second chamber when air pressure within said second chamber is less than air pressure of said inlet source.

13. A pneumatic fastener driving device as defined in claim 12 wherein said means for shifting said valve sleeve to said second position comprises a first port in said first chamber to pressurize a first surface of said sleeve when said piston passes thereby during said power stroke, a second port in said second chamber pressurizes a second surface of said sleeve to return said sleeve to said first position when said cylindrical tube passes thereby during said return stroke.

14. A pneumatic fastener driving device as defined in claim 10 wherein a fourth valve means is held closed when said air inlet source is connected to said device and opens to provide communication between said reservoir and atmosphere when said air inlet source is disconnected from said device.

15. A pneumatic fastener driving device having a housing and comprising within said housing:

a) a cylinder;
b) a piston and driver combination slidable within said cylinder;
c) valve means for providing reciprocal movement of said piston and driver combination;
d) trigger means controlling said valve means;
e) a cavity to function as an air pressure reservoir;
f) air pressure amplifier means communicating with said cavity for increasing the air pressure within said cavity above that of said air supply connected to said device;
g) said air pressure amplifier means further comprising:
   (1) a first chamber;
   (2) a piston having slidable movement within said first chamber;
   (3) a second cylindrical chamber having a smaller volume than that of said first chamber;
   (4) a cylindrical tube slidable within said second cylindrical chamber;
   (5) first valve means positioned to provide said air supply to the top side of said piston providing power stroke within said first chamber, said power stroke of said piston in turn moves said cylindrical tube in a volume reducing direction within said second cylindrical chamber;
   (6) check type valve means positioned to communicate between said second cylindrical chamber and said reservoir whenever pressure within said second cylindrical chamber becomes greater than the pressure within said reservoir and blocks communication when pressure within said second chamber is less than pressure within said reservoir;
   (7) a first port in said first chamber to pressurize a first surface of said first valve means when said piston passes thereby during said power stroke of piston, said first valve means shifts when said first surface is pressurized blocking air supply to said top side of said piston and providing communication of said top side of said piston to atmosphere, pressure within said second chamber causes a second movement of said cylindrical tube in an opposite direction, said second movement of said cylindrical tube in turn moves said piston to its original position;

(8) a second port in said second cylindrical chamber to pressurize a second surface of said first valve means when said cylindrical tube passes thereby during said second movement of said cylindrical tube, said first valve means shifts back to its original position when said second surface is pressurized breaking communication between said top side of said piston and atmosphere and again providing said air supply to said top side of said piston, said shifting of said first valve means and said movements of said piston and said cylindrical tube continues in a reciprocal manner until the increased air pressure acting upon the area of the portion of the said cylindrical tube within said second chamber creates a force equal and opposite to that created by said air supply acting upon said top side of said piston.

* * * * *